US006811247B2

(12) United States Patent
Tominaga et al.

(10) Patent No.: US 6,811,247 B2
(45) Date of Patent: Nov. 2, 2004

(54) INK JET HEAD AND INK JET RECORDING APPARATUS

(75) Inventors: Kazuyoshi Tominaga, Chiba (JP); Osamu Koseki, Chiba (JP); Kentaro Suzuki, Chiba (JP); Yuji Nakamura, Chiba (JP); Yasuhito Sekiya, Chiba (JP); Jun Tsuneyoshi, Chiba (JP); Tomiharu Makishima, Chiba (JP); Masaki Denda, Chiba (JP)

(73) Assignee: SII Printek Inc., Chiba (JP)

( * ) Notice: Subject to any disclaimer, the term of this patent is extended or adjusted under 35 U.S.C. 154(b) by 0 days.

(21) Appl. No.: 10/434,322

(22) Filed: May 8, 2003

(65) Prior Publication Data

US 2003/0234845 A1 Dec. 25, 2003

(30) Foreign Application Priority Data

Jun. 21, 2002 (JP) ..... 2002-181955

(51) Int. Cl.[7] ..... B41J 2/04
(52) U.S. Cl. ..... 347/54
(58) Field of Search ..... 347/54, 68–72, 347/50, 40, 20, 44, 47, 27, 63; 399/261; 361/700; 29/890.1; 310/328–330

(56) References Cited

FOREIGN PATENT DOCUMENTS

JP 404241949 A * 8/1992

* cited by examiner

*Primary Examiner*—Raquel Yvette Gordon
(74) *Attorney, Agent, or Firm*—Adams & Wilks

(57) ABSTRACT

To provide an ink jet head and an ink jet recording apparatus in which it is possible to reliably prevent ink bubbles from staying in the ink sump and the interior of the head chip and in which it is relatively easy to remove the bubbles. The ink jet head includes: a plurality of grooves arranged side by side so as to communicate with nozzle openings; an ink chamber for supplying ink to each of the grooves; an ink sump provided so as to communicate with the ink chamber; and ink storage unit (50) communicating with the ink sump through ink supply passages, in which there is provided an air duct (100) establishing communication between a region in the ink sump which is substantially free from interference with an ink flow from the ink supply passages (33) to the ink chamber and in which bubbles easily gather and an air region of the ink storage unit (50). Therefore, the bubbles in the ink can be surely removed.

6 Claims, 9 Drawing Sheets

INK JET HEAD AND INK JET RECORDING APPARATUS

BACKGROUND OF THE INVENTION

1. Field of the Invention

The present invention relates to an ink jet head and an ink jet recording apparatus applicable, for example, to a printer or a facsimile machine.

2. Description of the Related Art

An ink jet recording apparatus has been known which records characters and images on a recording medium by using an ink jet head having a plurality of nozzles for ejecting ink. In such an ink jet recording apparatus, the nozzles of the ink jet head are provided in a head holder so as to be opposed to the recording medium, and the head holder is mounted on a carriage, with which scanning is performed in a direction perpendicular to the direction in which the recording medium is transported.

FIG. 11 is an exploded perspective view of an example of such an ink jet head. As shown in FIG. 11, a plurality of grooves 132 are arranged side by side in a piezoelectric ceramic plate 131, and the grooves 132 are separated from each other by partition walls 133. One longitudinal end portion of each groove 132 extends to one end surface of the piezoelectric ceramic plate 131, whereas the other end portion thereof does not extend to the other end surface, and its depth gradually decreases. Further, on the opening side surfaces of the partition walls 133 on both sides of each groove 132, electrodes 134 for applying a drive electric field are formed so as to extend in the longitudinal direction.

Further, attached to the opening side of the grooves 132 of the piezoelectric ceramic plate 131 is an ink chamber plate 136 defining a common ink chamber 135 communicating with the shallow end portions of the grooves 132.

Further, fixed to the ink chamber plate 136 is a flow passage substrate 138 which seals one side of the common ink chamber 135 and which has a communication hole 137 communicating with an ink supply passage for supplying ink to the common ink chamber 135.

Provided in the flow passage substrate 138 is an ink sump 139 constituting a part of the ink flow passage for supplying ink from the communication hole 137 to the common ink chamber 135.

A nozzle plate 140 is attached to the end surface of the joint unit formed by the piezoelectric ceramic plate 131 and the ink chamber plate 136 where the grooves 132 are open, and nozzle openings 141 are formed at the positions of the nozzle plate 140 opposed to the grooves 132.

In this ink jet head, constructed as described above, the grooves 132 are filled with ink from the communication hole 137, and when a predetermined drive electric field is applied to the partition walls 133 on both sides of a predetermined groove 132 through the electrodes 134, the partition walls 133 are deformed to change the volume of the predetermined groove 132, whereby the ink in the groove 132 is ejected from the corresponding nozzle opening 141.

In this ink jet head, the diameter of the nozzle openings 141 is very small, so that even if the volume of each groove 132 is varied, it is impossible to eject ink from the nozzle openings 141 in a satisfactory manner unless back pressure is generated in each groove 132 from the common ink chamber 135 side.

In view of this, in the conventional ink jet head, a mesh-like filter 142 formed, for example, of stainless steel (SUS), is provided between the ink sump 139 and the common ink chamber 135. Due to this filter 142, back pressure is generated in the grooves 132 to eject ink droplets from the nozzle openings 141.

The ink sump of the conventional ink jet head, however, includes a region where ink does not flow easily. For example, in a region such as a corner of the ink sump, the ink supplied to the ink sump does not flow easily, with the result that bubbles stay in that region. When bubbles stay in such a region, the volume of the ink sump changes, resulting in a deficiency in the ink supply to the ink chamber. In particular, when, for example, an ink with poor bubble permeability such as a water-color ink is used, bubbles are likely to be generated in the ink, with the result that the deficiency in ink supply is gradually aggravated.

It is general practice to remove the bubbles thus accumulated in the ink sump through a so-called cleaning operation in which the bubbles are sucked from the nozzle opening side. However, even by this cleaning operation, it is difficult to substantially remove the bubbles staying in the portion of the ink sump on the upstream side of the filter, which do not pass through the filter.

In an ink jet head in which bubbles cannot be removed from a region where ink does not flow easily, bubbles staying in the ink sump may pass through the filter to be ejected together with ink during printing, thereby causing a printing failure. Thus, such an ink jet head is to be disposed of, resulting in a poor yield rate.

Further, when the size of the ink droplets is large or the number of nozzle openings is large, that is, when the amount of ink ejected per unit time is large, the amount of bubbles existing, in particular, in the ink sump, is large, so that the area of the ink flow passage is substantially reduced, resulting in the deficiency in the ink supply to the ink chamber being gradually aggravated.

It might be possible to accelerate the ink flow by narrowing the flow passage of the ink sump to thereby prevent the bubbles in the ink sump from staying. This, however, would involve a substantial reduction in the filter size, resulting in a deficiency in the ink supply to the common ink chamber. Further, even by adopting this method, it is impossible to completely remove the bubbles staying in the portion of the ink sump on the upstream side of the filter through the above-mentioned cleaning operation.

SUMMARY OF THE INVENTION

The present invention has been made in view of the above problem in the prior art. It is an object of the invention to provide an ink jet head and an ink jet recording apparatus in which it is possible to reliably prevent ink bubbles from staying in the ink sump and the interior of the head chip and in which it is relatively easy to remove the bubbles.

According to a first aspect of the present invention for solving the above-mentioned object, there is provided an ink jet head including: a plurality of grooves arranged side by side so as to communicate with nozzle openings; an ink chamber for supplying ink to each of the grooves; an ink sump provided so as to communicate with the ink chamber; and ink storage unit communicating with the ink sump through ink supply passages, characterized in that there is provided an air duct establishing communication between a region in the ink sump which is substantially free from interference with an ink flow from the ink supply passages to the ink chamber and in which bubbles easily gather and an air region of the ink storage means.

According to a second aspect of the present invention, in the first aspect of the present invention, the ink jet head is characterized in that the ink chamber is provided so as to extend over the direction in which the grooves are arranged side by side, that the ink chamber and the ink sump communicate with each other over the direction in which the grooves are arranged side by side, that the ink supply passages are provided on both sides of the ink sump with respect to the direction in which the grooves are arranged side by side, and that the air duct is provided between the ink supply passages.

According to a third aspect of the present invention, in the first or second aspect of the present invention, the ink jet head is characterized in that the ink sump is equipped with a tapered portion gradually diverging from at least one of the openings of the ink supply passages and the air duct toward the ink chamber.

According to a fourth aspect of the present invention, in any one of the first to third aspects of the present invention, the ink jet head is characterized in that the ink sump is equipped with a filter situated in the vicinity of the border between the ink sump and the ink chamber.

According to a fifth aspect of the present invention, in the fourth aspect of the present invention, the ink jet head is characterized in that the air duct communicates with the portion of the ink flow passage which is on the upstream side of the filter of the ink sump.

According to a sixth aspect of the present invention, there is provided an ink jet recording apparatus equipped with an ink jet head according to any one of the first to fifth aspects.

According to the present invention, there is provided an air duct establishing communication between a region which is substantially free from interference with the ink flow in the ink sump from the ink supply passage to the ink chamber and in which bubbles gather easily and the air region of the ink storage unit, whereby it is possible to reliably prevent the bubbles in the ink from remaining in the ink sump and the interior of the head chip, and the bubbles can be removed relatively easily.

DESCRIPTION OF THE PREFERRED EMBODIMENTS

Embodiments of the present invention will now be described in detail.

Embodiment 1

Figure 1:
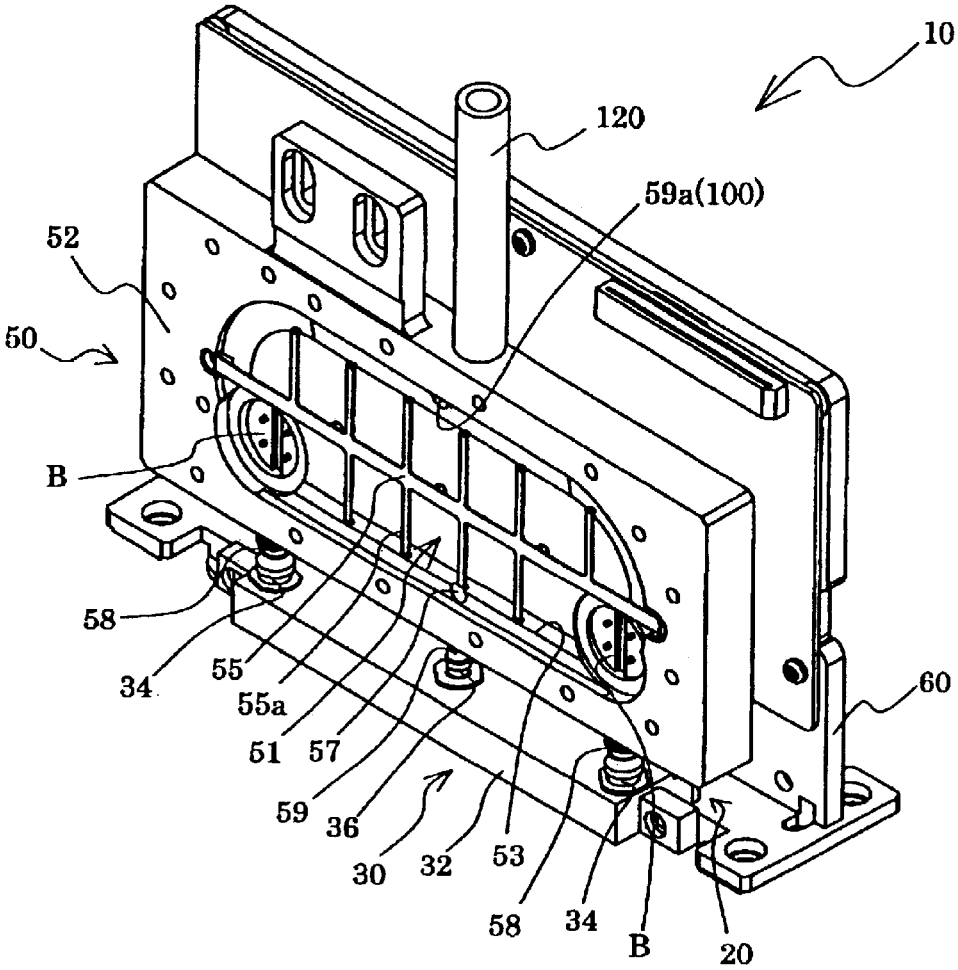
FIG. 1 is a perspective view of an ink jet head according to Embodiment 1 of the present invention.
Figure 2A:
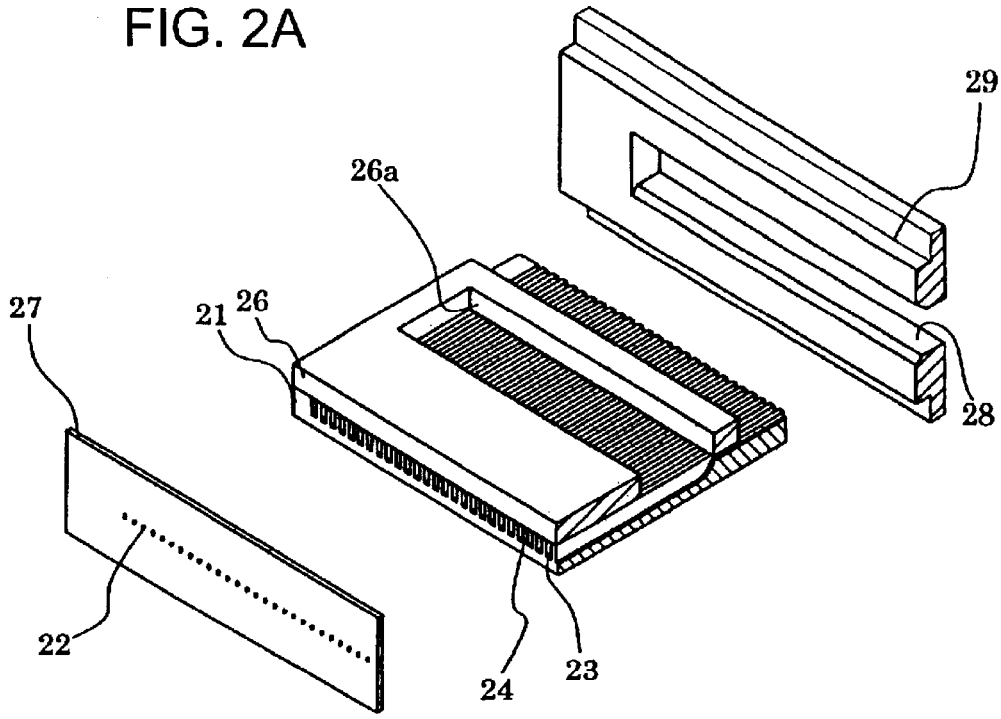
FIGS. 2A and 2B are an exploded perspective view and a perspective sectional view of a head chip according to Embodiment 1 of the present invention.
Figure 2B:
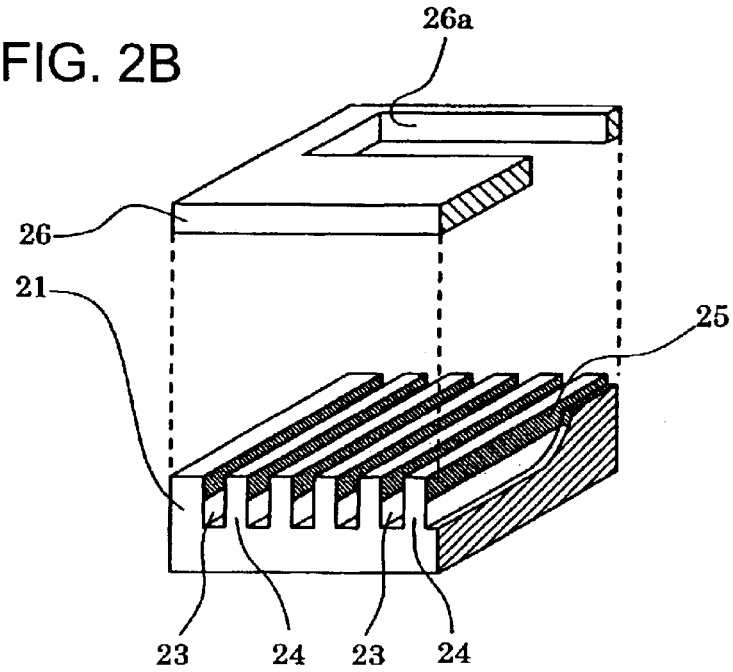
Figure 3:
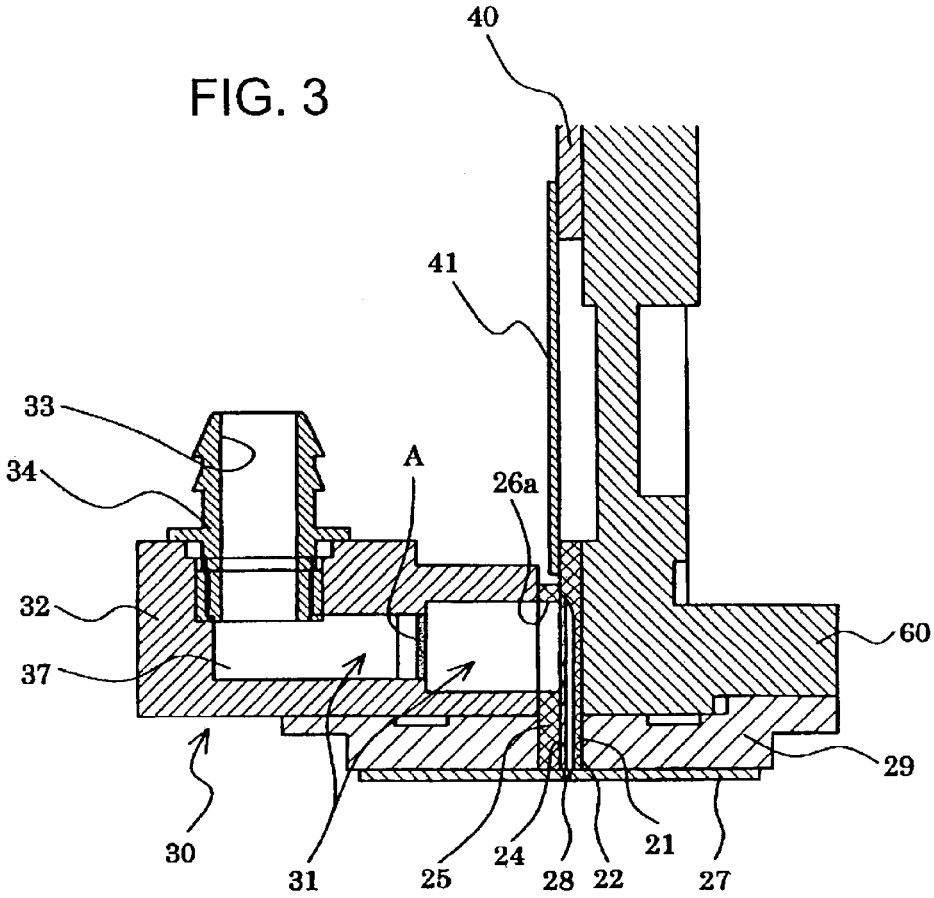
FIG. 3 is a sectional view of a main portion of the ink jet head of Embodiment 1 of the present invention.
Figure 4:
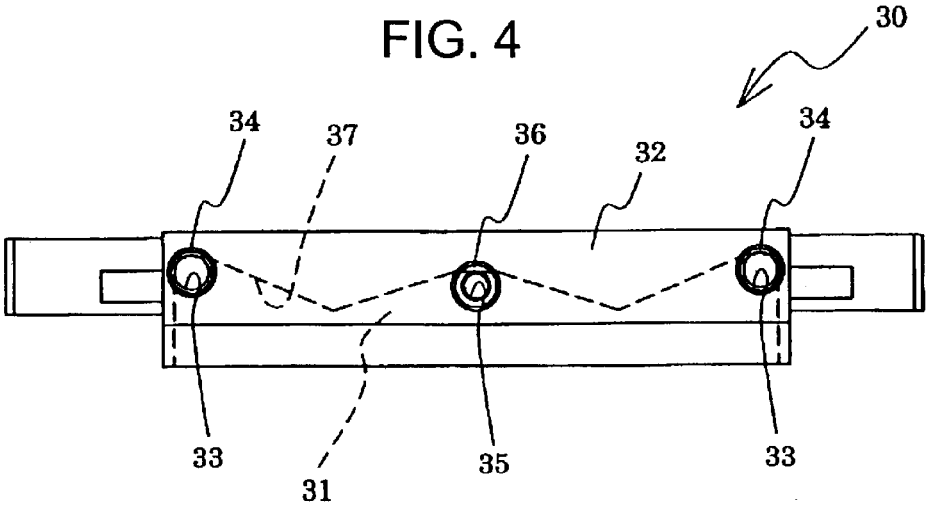
FIG. 4 is a top plan view of a flow passage substrate of the ink jet head of Embodiment 1 of the present invention.

FIG. 1 is a perspective view of an ink jet head according to Embodiment 1. FIGS. 2A and 2B are an exploded perspective view and a perspective sectional view of a head chip. FIG. 3 is a sectional view of a main portion of the ink jet head. FIG. 4 is a top plan view of a flow passage substrate.

As shown in the drawings, an ink jet head 10 according to this embodiment comprises a head chip 20, a flow passage substrate 30 provided on one side thereof, a wiring board 40 on which a drive circuit for driving the head chip 20, etc. are mounted, and an air damper 50 for mitigating the pressure variation in the head chip 20. These components are fixed to a base plate 60.

In a piezoelectric ceramic plate 21 constituting the head chip 20, there are arranged side by side a plurality of grooves 23 communicating with nozzle openings 22, and the grooves 23 are separated from each other by partition walls 24. One longitudinal end portion of each groove 23 extends to one end surface of the piezoelectric ceramic plate 21, whereas the other longitudinal end portion thereof does not extend to the other end surface, and its depth gradually decreases. Further, on the opening side of the partition walls 24 on both sides of each groove 23 with respect to the width direction thereof, electrodes 25 for applying a drive electric field are formed so as to extend in the longitudinal direction.

The grooves 23 arranged in the piezoelectric ceramic plate 21 are formed by, for example, a disc-shaped dice cutter, and the portions thereof whose depth gradually decreases are made in conformity with the configuration of the dice cutter. The electrodes 25 formed within the grooves 23 are formed, for example, by a well-known oblique deposition method.

Connected to the electrodes 25 provided on the opening side of the partition walls 24 on both sides of each groove 23 is one end of an external wiring 41 such as a flexible print cable (FPC), and the other end of the external wiring 41 is connected to a drive circuit (not shown) on the wiring board 40, whereby the electrodes 25 are electrically connected to the drive circuit.

Further, an ink chamber plate 26 is joined to the opening side of the grooves 23 of the piezoelectric ceramic plate 21. The ink chamber plate 26 is equipped with a common ink chamber 26*a* formed by cutting in the thickness direction and extending over the entire grooves 23 arranged side by side.

The ink chamber plate 26 can be formed of a ceramic plate, a metal plate or the like. Taking into account the deformation after it is joined to the piezoelectric ceramic plate 21, however, it is desirable to use a ceramic plate whose coefficient of thermal expansion is close to that of the piezoelectric ceramic plate 21.

Further, a nozzle plate 27 is attached to the end surface of the joint unit formed by the piezoelectric ceramic plate 21 and the ink chamber plate 26 where the grooves 23 are open, and nozzle openings 22 are formed in the nozzle plate 27 at positions opposed to the grooves 23.

In this embodiment, the area of the nozzle plate 27 is larger than the area of the end surface of the joint unit of the piezoelectric ceramic plate 21 and the ink chamber plate 26 where the grooves 23 are open. The nozzle plate 27 consists of a polyimide film or the like, and the nozzle openings 22 are formed therein by using, for example, an excimer laser device. Further, although not shown, provided on the surface of the nozzle plate 27 opposed to the printing medium is a water-repellent film for preventing adhesion of ink or the like.

Further, joined to the outer peripheral surface of the end surface of the joint unit of the piezoelectric ceramic plate 21 and the ink chamber plate 26 on the side where the grooves 23 are open is a nozzle support plate 29 equipped with an engagement hole 28 to be engaged with the joint unit. This nozzle support plate 29 is joined to the outer side of the end surface of the joint unit of the nozzle plate 27 to hold the nozzle plate 27 in a stable manner.

The surface of the piezoelectric ceramic plate 21 of the above-described head chip 20 on the opposite side of the ink chamber plate 26 is fixed to the base plate 60. The flow passage substrate 30 is attached to one surface of the ink chamber plate 26.

The flow passage substrate 30 will be described in detail with reference to FIGS. 3 and 4. FIG. 4 is a top plan view of the ink jet head flow passage substrate of Embodiment 1 of the present invention.

As shown in the drawings, the flow passage substrate 30 comprises a flow passage main body 32 having an ink sump 31, connecting portions 34 which are provided on both longitudinal ends of the flow passage main body 32 and in which ink supply passages 33 are open, and a protruding portion 36 which is provided between the connecting portions 34 and in which a discharge hole 35 for discharging bubbles in the ink sump 31 is open.

The ink sump 31 communicates with the ink supply passages 33 and the discharge hole 35, and ink from an air damper 50 described below is supplied thereto through the ink supply passages 33.

Further, in the portion of the ink sump 31 opposed to the common ink chamber 26*a*, a filter A for removing dust or the like mixed in the ink is provided so as to extend in the direction in which the grooves 23 are arranged side by side. The filter A also serves to generate back pressure for each groove 23 when ink is ejected.

Further, the ink sump 31 is equipped with tapered portions 37 gradually increasing the ink flow passage from the ink supply passages 33 and the discharge hole 35 toward the common ink chamber 26*a*. In this embodiment, the tapered portions 37 are provided so as to extend to a position in front of the filter A and join together in front of it.

In the ink sump 31 of this embodiment, the inflow direction of the ink from the ink supply passages 33 and the inflow direction of the ink supplied to the common ink chamber 26*a* are substantially perpendicular to each other. Then, the ink supplied to the ink sump 31 from the ink supply passages 33 is supplied to the common ink chamber 26*a* through the filter A while being accelerated by the action of the above-mentioned tapered portions 37.

Further, in this embodiment, the connecting portions 34 protrude along the base plate 60 from the upper portion on either side with respect to the width direction of the flow passage main body 32. Then, in this embodiment, the flow passage substrate 30 and the air damper 50 are connected through the connecting portions 34, and ink from the air damper 50 is supplied to the ink sump 31 through the ink supply passages 33 of the connecting portions 34.

Further, in this embodiment, the protruding portion 36 protrudes from the upper portion substantially at the center of the flow passage substrate 30 so as to be substantially parallel to the connecting portions 34. As will be described in detail below, the discharge hole 35 of this protruding portion 36 constitutes a part of an air duct for guiding bubbles staying in the ink sump 31 to the air damper 50.

In this embodiment, the connecting portions 34 and the protruding portion 36 described above are formed integrally with the flow passage main body 32 by molding or the like. Of course, this should not be construed restrictively. They may also be formed as separate components joined together by screws.

Figure 5:
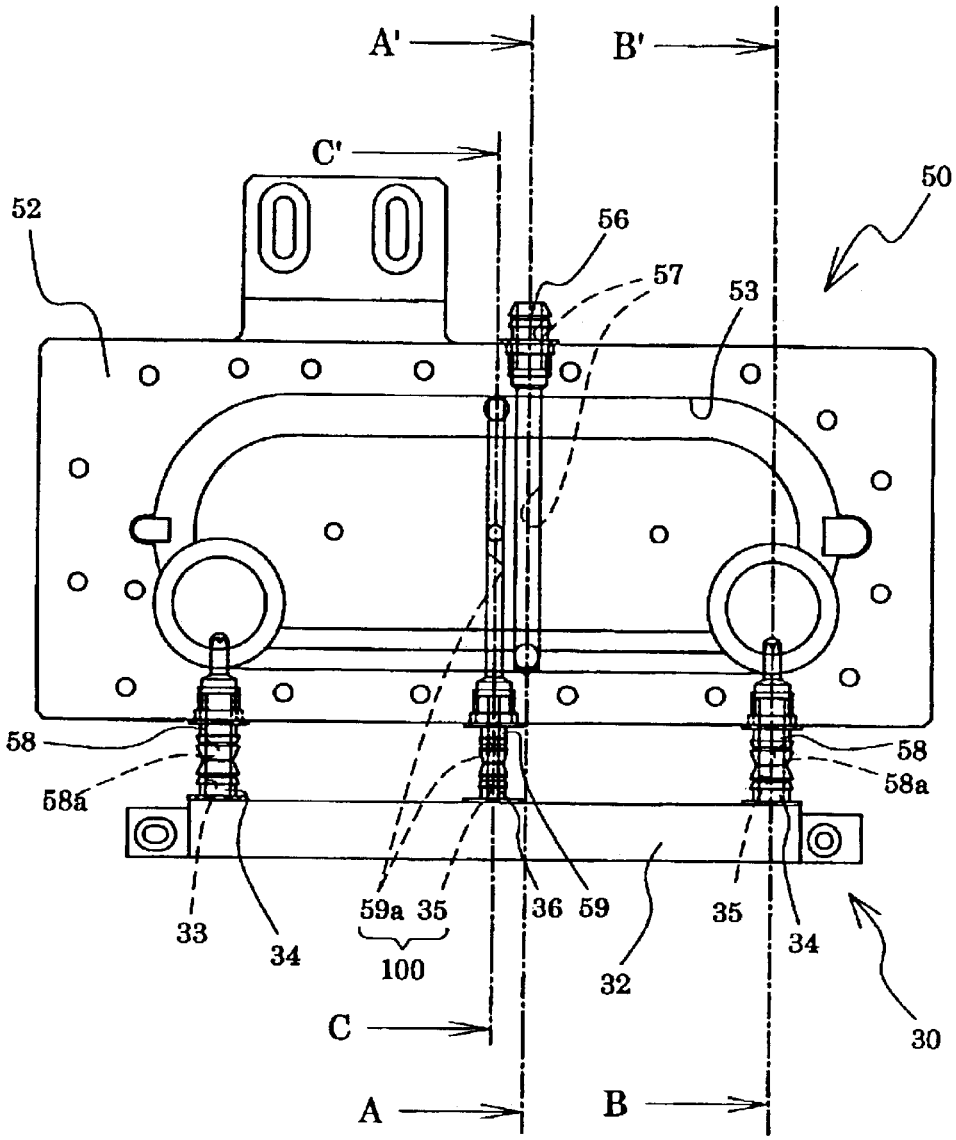
FIG. 5 is a schematic plan view of the flow passage substrate and air damper of the ink jet head of Embodiment 1 of the present invention.
Figure 6:
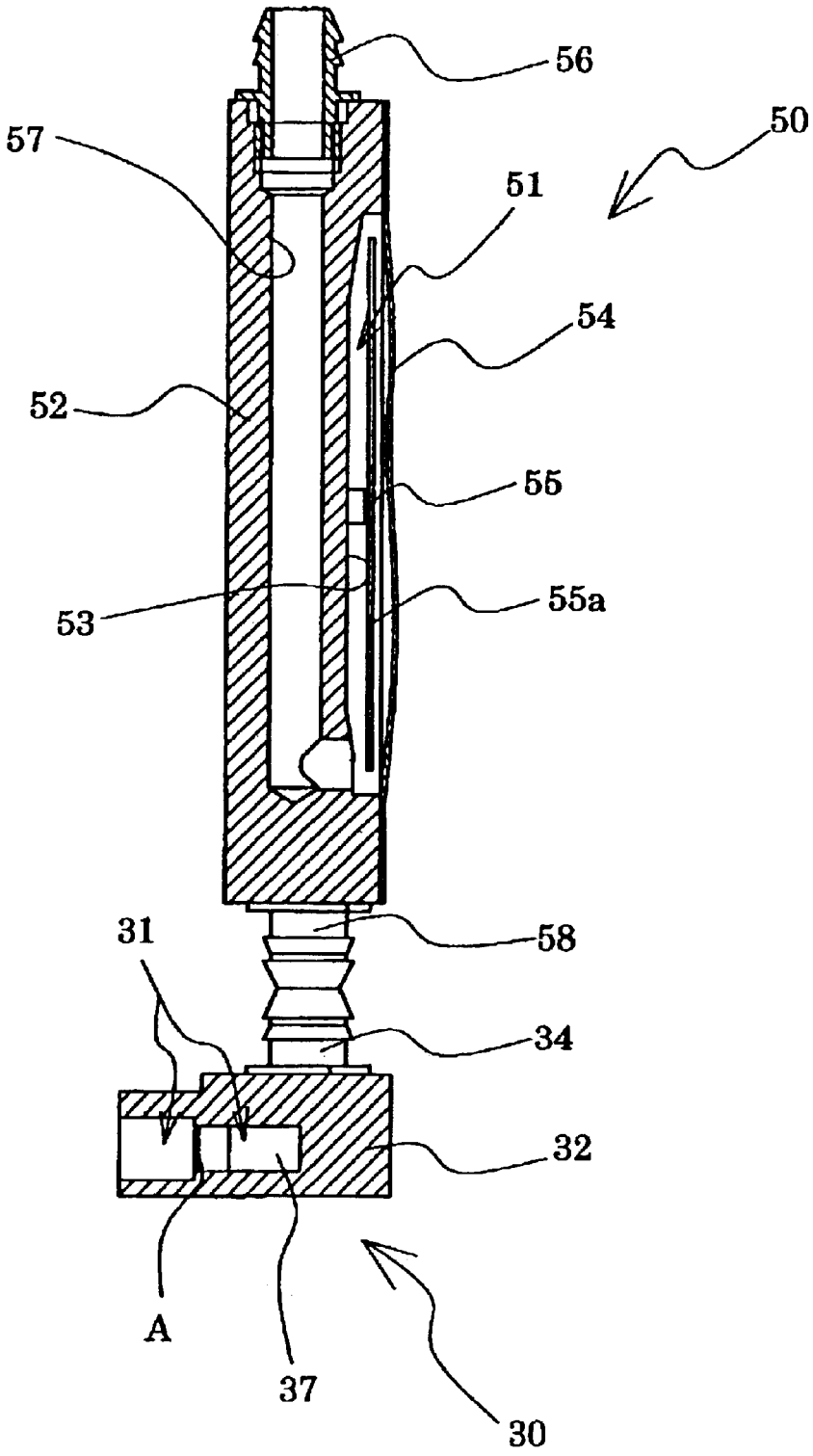
FIG. 6 is a sectional view taken along the arrow line A–A' of FIG. 5 showing Embodiment 1 of the present invention.
Figure 7:
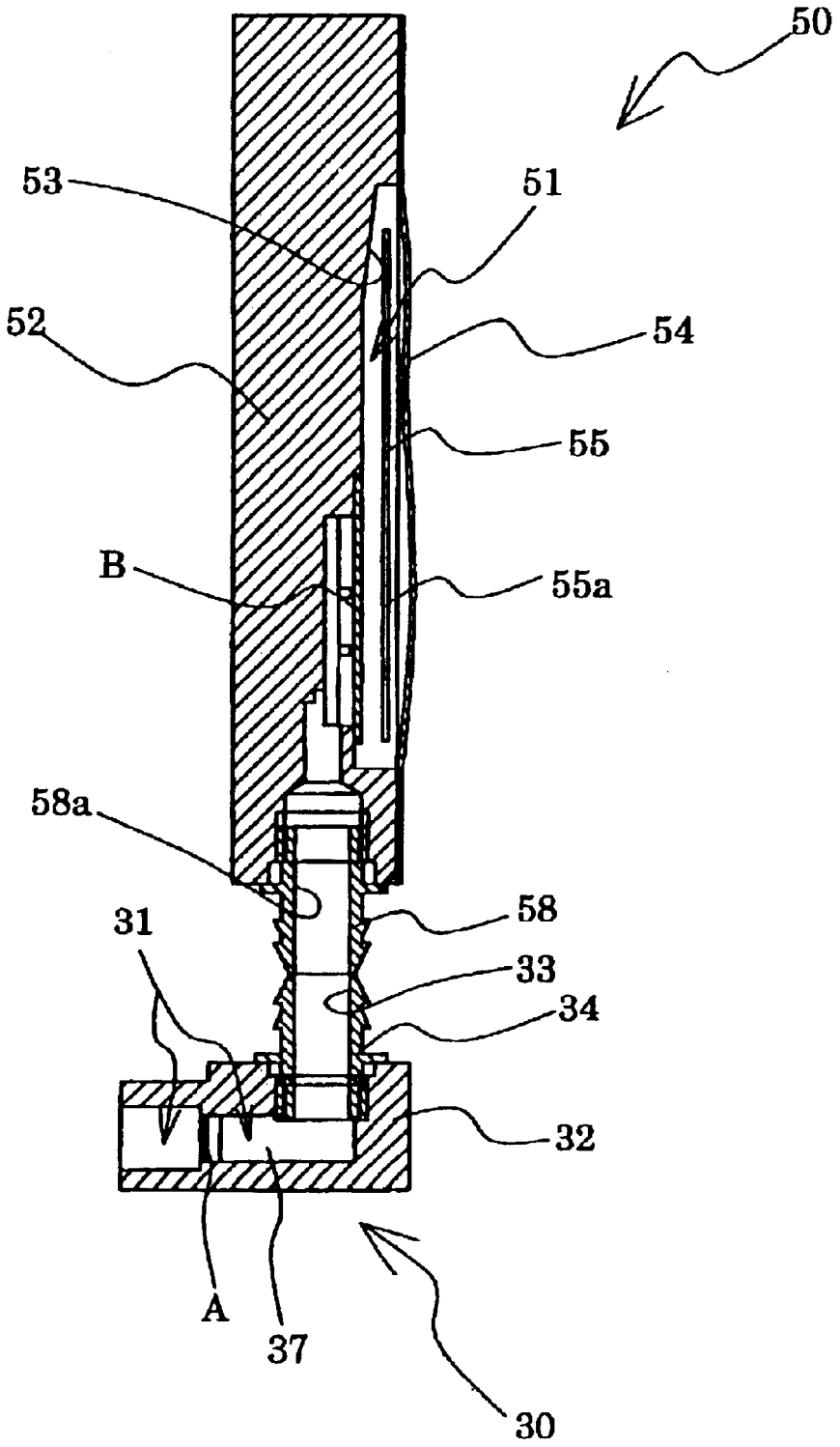
FIG. 7 is a sectional view taken along the arrow line B–B' of FIG. 5 showing Embodiment 1 of the present invention.
Figure 8:
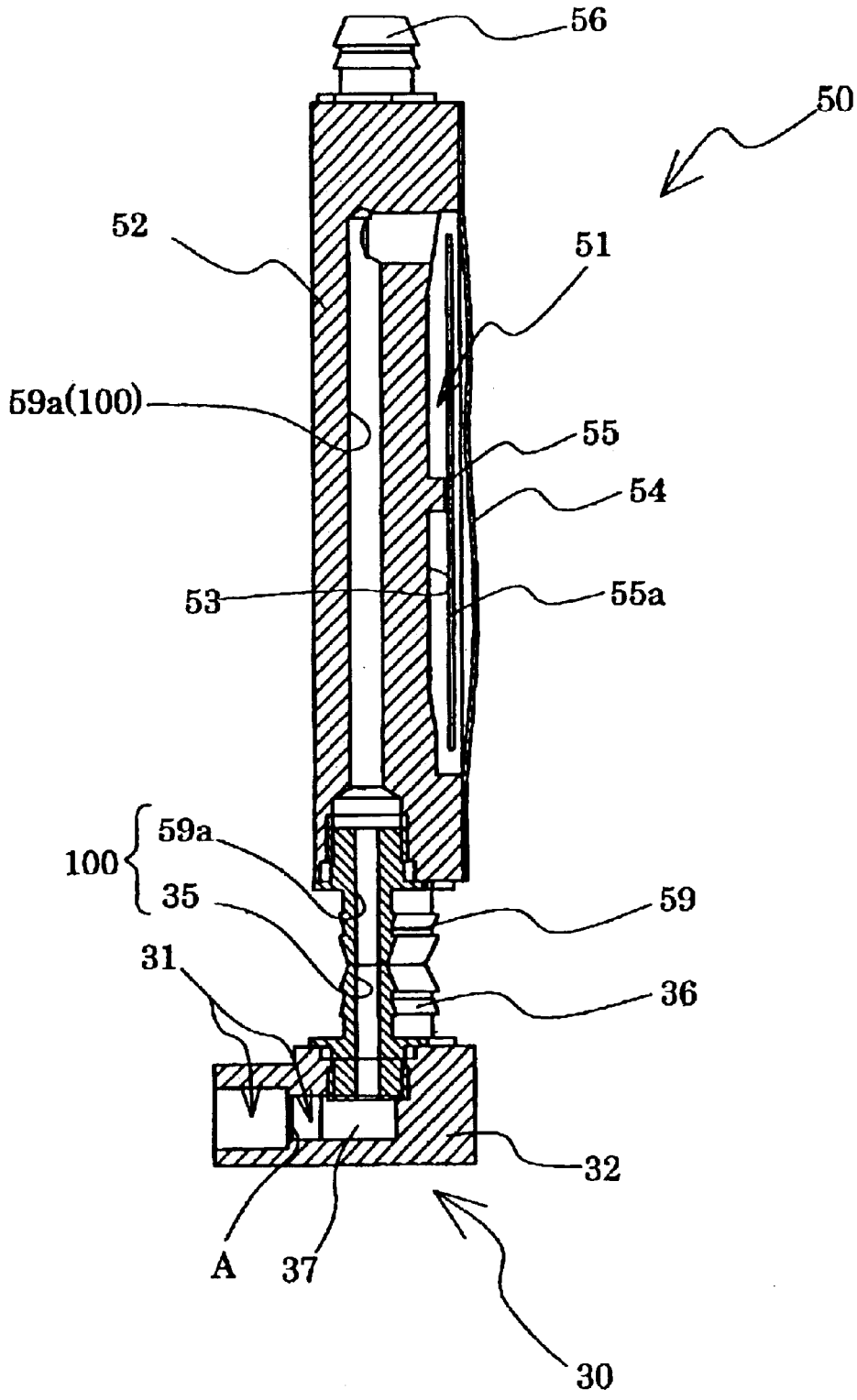
FIG. 8 is a sectional view taken along the arrow line C–C' of FIG. 5 showing Embodiment 1 of the present invention.
Figure 9:
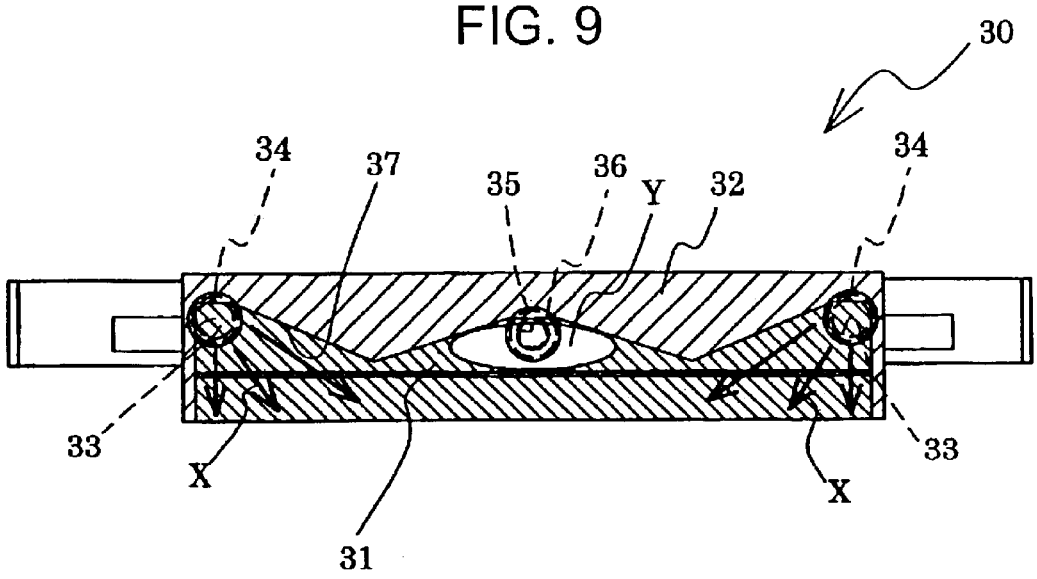
FIG. 9 is a schematic sectional view of the flow passage substrate of the ink jet head of Embodiment 1 of the present invention.

Next, the air damper 50 for supplying ink to the ink sump 31 of the above-described flow passage substrate 30 will be described in detail with reference to FIGS. 5 through 8. FIG. 5 is a schematic plan view of the flow passage substrate and the air damper. FIG. 6 is a sectional view taken along the arrow line A–A' of FIG. 5, FIG. 7 is a sectional view taken along the arrow line B–B' of FIG. 5, and FIG. 8 is a sectional view taken along the line C–C' of FIG. 5. FIG. 9 is a schematic sectional view of the flow passage substrate.

As shown in the drawings, the air damper 50 comprises a damper main body 52 having an ink storage portion 51 storing ink, a recess 53 provided in the end surface of the damper main body 52 on the opposite side of the base plate 60, a film-like member 54 sealing the recess 53, and a damper plate 55 retained in the ink storage portion 51 and formed as a thin plate.

The ink storage portion 51 is a space defined by closely attaching the film-like member 54 to the edge portion of the side of the damper main body 52 where the recess 53 is open. Due to this film-like member 54, the air and ink inside the ink storage portion 51 are prevented from leaking out.

Inside the ink storage portion 51, there is provided a damper plate 55 consisting of a plate-like member of stainless steel or the like. This damper plate 55 is held by the damper main body 52 so as to form a predetermined clearance with the bottom wall of the recess 53.

Further, the damper plate 55 has a plurality of arm portions 55*a* protruding in the vertical direction as seen in the drawings so as to cover a wide range with respect to the face of the film-like member 54, whereby it is possible to prevent the film-like member 54 from coming into contact with the bottom wall of the recess 53, making it possible to maintain a fixed ink filling amount in the ink storage portion 51.

Further, at the center of the upper portion of the damper main body 52, there is provided a cylindrical joint member 56 to which an ink supply tube 120 consisting of a flexible tube of rubber, plastic or the like connected to an ink tank described below is to be connected (See FIG. 1).

As shown in FIG. 6, this joint member 56 communicates with a filling passage 57 for filling the ink storage portion 51 with ink. More specifically, this filling passage 57 extends from the joint member 56 behind the recess 53 of the damper main body 52 to communicate with the bottom surface of the recess 53 on the flow passage substrate 30 side.

As shown in FIG. 7, on either side of the lower portion of the damper main body 52, a supply pipe 58 having a supply passage 58*a* communicating with the ink storage portion 51 protrudes along the base plate 60. In the boundary between the ink storage portion 51 and each supply passage 58*a*, there is provided a filter B for removing dust or the like mixed in the ink.

In this embodiment, the supply pipes 58 and the connecting portions 34 of the flow passage substrate 30 are connected through connecting tubes 200 (See FIG. 1) of rubber, plastic or the like, thereby forming ink flow passages for supplying the ink filling the ink storage portion 51 to the ink sump 31.

Then, in the ink jet head 10 of this embodiment, ink from the ink tank is supplied through the filling passage 57 to fill the ink storage portion 51 at the time of initial filling, etc. Further, the ink in the ink storage portion 51 is supplied to the interior of the head chip 20 through the ink sump 31, that is, to the grooves 23 by way of the common ink chamber 26*a*.

After the grooves 23 have been thus filled with ink, there are formed in the ink storage portion 51 an ink region filled with ink and an air region filled with air.

Then, the ink storage portion 51 serves to adjust the pressure of the ink in the common ink chamber 26*a* and the grooves 23 of the head chip 20. More specifically, when the ink jet head 10 moves in the main scanning direction, the pressure in the head chip 20 changes, which may destroy the meniscus formed in the nozzle openings 22 by the surface tension of the ink. In view of this, the change in the pressure in the head chip 20 is adjusted by the ink storage portion 51, whereby ink can be ejected while maintaining a stable meniscus. This ink storage portion 51 stores a predetermined amount of ink and gas such as air therein to thereby contribute to bubble storage for preventing bubbles in the ink supply pipe 120 from entering the common ink chamber 26*a*.

As shown in FIG. 8, in this embodiment, at the center of the damper main body 52 between the above-mentioned supply pipes 58, there protrudes along the base plate 60 a protrusion 59 in which a communication passage 59*a* communicating with the air region of the ink storage portion 51 is open. This communication passage 59*a* extends behind the recess 53 of the damper main body 52 to communicate with the bottom surface of the recess 53 of the ink storage portion 51 on the opposite side of the filling passage 57.

Then, in this embodiment, this protrusion 59 and the protruding portion 36 of the flow passage substrate 30 are connected through the connecting tube 200 (See FIG. 1), whereby the communication passage 59*a* and the discharge hole 35 communicate with each other, forming an air duct 100 which is a piping for establishing communication between the ink sump 31 and the air region of the ink storage portion 51.

In this embodiment, this air duct 100 establishes communication between a region in the ink sump 31 where there is substantially no interference with the ink flow to the common ink chamber 26*a* and where bubbles are likely to stay and the air region of the ink storage portion 51.

More specifically, as described above, in the ink jet head 10 of this embodiment, the ink storage portion 51 and the ink sump 31 communicate with each other on either side of the lower portion of the damper main body 52. Thus, as shown in FIG. 9, the ink X having flowed into the ink sump 31 from the ink storage portion 51 through the ink supply passages 33 flows toward the common ink chamber 26*a* along the tapered portions 37 of the ink sump 31. Thus, upstream side of the ink flow passage positioned between the openings of the ink supply passages 33 of the ink sump 31 constitutes a region substantially free from interference with the ink flow, that is, a region where ink does not flow easily. This region where ink does not easily flow is the region where bubbles Y existing in the ink are easily allowed to stay.

In view of this, in this embodiment, there is provided the air duct 100 which is a piping connecting the region substantially free from interference with the ink flow and the air region of the ink storage portion 51 where the internal pressure is maintained at a fixed level, whereby for example, at the time of initial filling, or cleaning, etc., the bubbles Y in the ink sump 31 pass through the air duct 100 to reach the air region of the air damper 50, thereby making it possible to efficiently remove the bubbles in the ink sump 31. In this embodiment, an effect is to be expected which allows removal of bubbles generated in the ink sump 31 even during ink ejection.

Further, in this embodiment, the internal pressure of the air region is maintained at a predetermined value, so that there is no fear of the ink of the ink sump 31 flowing reversely to the ink storage portion 51 through the air duct 100, and it is possible to selectively introduce the bubbles Y alone from the ink sump 31 to the air region.

Further, by applying a predetermined pressure to the ink from the air damper 50 side, the bubbles in the ink sump 31 are easily gathered substantially at the center of the ink sump 31, so that it is also possible to introduce the bubbles in the ink sump 31 still more efficiently to the air region through the air duct 100. As the bubbles in the ink sump 31 are thus introduced to the air region in the ink storage portion 51, the air region substantially increases. Then, the film-like member 54 absorbs the internal stress inside the ink storage portion 51, so that it swells outwardly. If it swells excessively, there is a fear of the film-like member 54 bursting to thereby cause the air and ink inside the ink storage portion 51 to leak out. In view of this, it is desirable to provide on the portion of the film-like member 54 on the side opposite to the damper main body 52 a reinforcing plate (not shown) for preventing the film-like member 54 from bursting which has a thickness, for example, of approximately 2 to 3 mm.

As described above, in the ink jet head 10 of this embodiment, it is possible to introduce exclusively the bubbles staying in the ink sump 31 to air region of the air damper 50 through the air duct 100, so that it is possible to reliably prevent bubbles from staying in the ink sump 31. As a result, it is possible to reliably prevent shortage in ink supply to the common ink chamber 26*a* and the grooves 23 due to variation in the volume of the ink sump 31 caused by remaining bubbles.

Further, in this embodiment, the air duct 100 communicates with the portion of the ink sump 31 on the upstream side of the ink flow passage of the filter A, whereby it is possible to remove relatively easily and reliably the bubbles which has been impossible to remove even by sucking from the nozzle openings 22 side, so-called cleaning operation.

In this embodiment, the bubbles in the portion of the ink flow passage on the upstream side of the filter A can be removed by the air duct 100, and the bubbles in the portion of the ink flow passage on the downstream side of the filter A can be removed through cleaning operation, so that it is possible to completely remove the bubbles in the ink sump 31 and the head chip 20 communicating with the ink sump 31.

In this way, it is possible to reliably prevent bubbles from remaining in the ink sump 31, so that there is no danger of bubbles remaining in the ink sump at the time of printing passing through the filter A to be ejected together with the ink, thereby reliably preventing a printing failure or the like and achieving an improvement in yield.

Of course, in the ink jet head 10 of this embodiment, even if, for example, the amount of ink ejected per unit time is large or an ink of poor bubble permeability like a water-color ink is used, it is possible to reliably prevent shortage in ink supply to the common ink chamber 26*a* and the grooves 23, thereby achieving an improvement in terms of stability in ink ejection and reliability.

Figure 10:
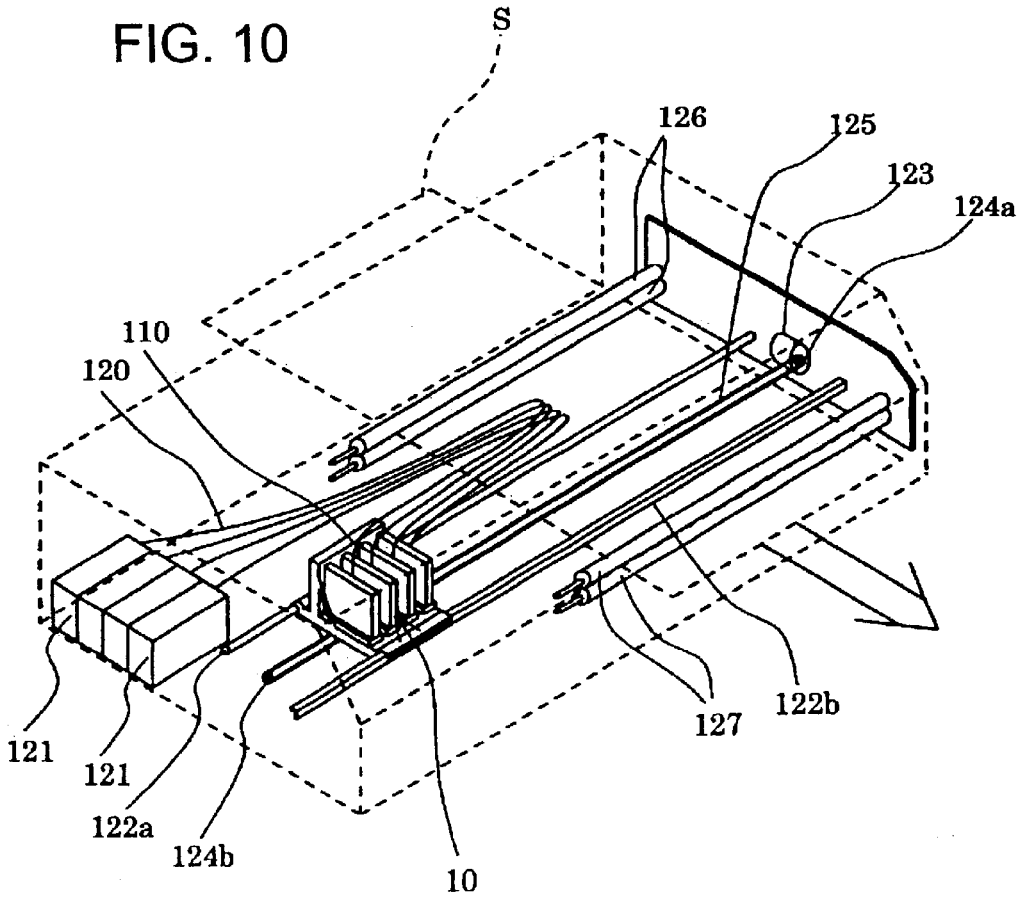
FIG. 10 is a schematic perspective view of an ink jet recording apparatus according to Embodiment 1 of the present invention.
Figure 11:
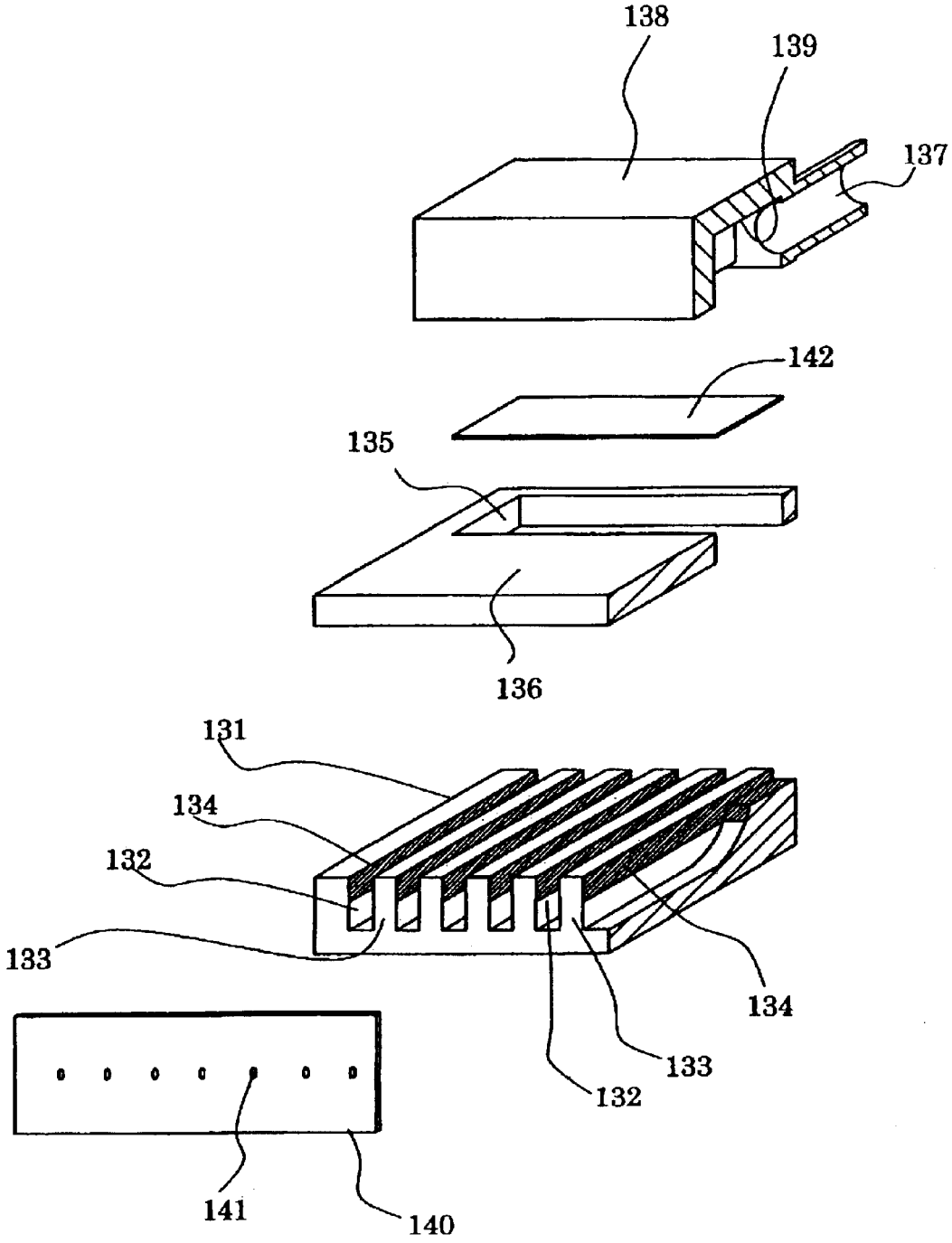
FIG. 11 PRIOR ART
FIG. 11 is a schematic exploded perspective view of a conventional ink jet head.

Here, a serial type ink jet recording apparatus in which the above-described ink jet head 10 is mounted will be described. FIG. 10 is a schematic perspective view of the ink jet recording apparatus.

As shown in FIG. 10, the ink jet recording apparatus is equipped with a plurality of ink jet heads 10 for different colors, a carriage 110 on which the plurality of ink jet heads 10 are arranged side by side in the main scanning direction, and ink cartridges 121 for supplying inks through ink supply tubes 120 consisting of flexible tubes. The carriage 110 is mounted so as to be axially movable on a pair of guide rails 122*a* and 122*b*. At one end of the guide rails 122*a* and 122*b*, there is provided a drive motor 123, whose driving force is transmitted through a timing belt 125 stretched between a pulley 124*a* connected to the drive motor 123 and a pulley 124*b* provided at the other end of the guide rails 122*a* and 122*b*.

Further, at the ends with respect to the direction perpendicular to the direction in which the carriage 110 is conveyed, there are respectively provided pairs of transport rollers 126 and 127 along the guide rails 122*a* and 122*b*, respectively. These transport rollers 126 and 127 serve to transport a recording medium S under the carriage 110 and in the direction perpendicular to the direction in which the carriage 110 is conveyed.

Then, while the recording medium S is transported by the transport rollers 126 and 127, scanning is performed with the carriage 110 in the direction perpendicular to the transporting direction, whereby characters, images, etc. are recorded on the recording medium S by the ink jet head 10.

As a result of the movement of the carriage 110, the pressure of the ink in the head chip 20 of the ink jet head 10 is changed. However, due to the provision of the air damper 50 in the ink jet head 10, pressure adjustment can be easily effected, thereby making it possible to execute a satisfactory ink ejection.

In this embodiment, four ink jet heads 10, each of which ejects a monochrome ink, are arranged side by side on the carriage 110 corresponding to the four colors: black (B), yellow (Y), magenta (M), and cyan (C).

Similarly, four ink cartridges 121 for different colors are provided corresponding to the ink jet heads 10. The ink cartridges 121 are provided at positions where they do not obstruct the movement of the carriage 110 in the main scanning direction and the movement of the recording medium S, and at positions lower than the nozzle openings 22 of the ink jet heads 10 by a predetermined distance so that negative pressure may be created in the ink jet heads 10.

Although not shown, the ink jet recording apparatus is provided with a suction unit for use in a so-called cleaning operation, in which ink is sucked from the nozzle openings 22. By this suction means, the ink in the common ink chamber 26*a* and the grooves 23 is sucked from the nozzle openings 22 side with a predetermined timing, whereby it is possible to reliably remove the bubbles existing in the ink in the common ink chamber 26*a* and the grooves 23, thereby making it possible to consistently maintain a satisfactory print quality.

While this embodiment has been described as applied to an ink jet recording apparatus on which ink cartridges 121 for four colors are mounted, this should not be construed restrictively. It is also applicable to an ink jet recording apparatus on which ink cartridges for five to eight colors are mounted.

Other Embodiments

The ink jet head and the ink jet recording apparatus of the present invention are not restricted to Embodiment 1 described above.

For example, while the ink jet head 10 of Embodiment 1 has the air duct 100 for establishing communication between the ink sump 31 and the air region of the air damper 50, there is no particular restriction regarding the air duct as long as it is provided so as to communicate with an air region existing in the ink flow passage between the ink storage unit such as the ink tank and air damper and the ink sump.

For example, in the case of a so-called line type ink jet recording apparatus in which the ink jet head is stationary, ink is directly supplied to the head chip from the ink tank, etc. Thus, a line type ink jet head has no air damper. Accordingly, in such a case, there is provided an air duct communicating with the air region of the ink tank. This construction provides the same effect as that of the above-described embodiment.

While the ink jet head 10 of Embodiment 1 has an ink supply passage 33 on either side of the flow passage substrate 30 with respect to the width direction, and the air duct 100 is provided between the ink supply passages 33, this should not be construed restrictively. It is also possible to provide an air duct 100 on either side of the flow passage substrate 30 with respect to the width direction and to provide the ink supply passage 33 between the air ducts 100. It is desirable for the air duct to be provided in a region substantially spaced apart from the opening of the ink supply passage of the ink sump. This is because a region spaced apart from the opening of the ink supply passage constitutes a region which is substantially free from interference with the ink flow in the ink sump and in which bubbles are easily gathered.

While in the above-mentioned Embodiment 1 the ink supply passages 33 and the discharge hole 35 are substantially parallel to each other, this should not be construed restrictively. It is only necessary for the discharge hole to be provided so as to communicate with a region substantially free from interference with the ink flow in the ink sump; its position is appropriately determined according to the positions of the ink supply passages.

Further, while in the above-mentioned Embodiment 1 the tapered portions 37 are respectively provided so as to extend from the openings of the ink supply passages 33 of the ink sump 31 and the air duct 100 toward the common ink chamber 26*a*, this should not be construed restrictively. It is also possible to provide a tapered portion in only either the ink supply passages or the air duct, or it is naturally also possible to provide none.

In any case, there is no particular restriction regarding the air duct as long as the ink jet head can be provided with an air duct for introducing exclusively bubbles to the air region, which is substantially free from interference with the ink flow in the ink sump and in which bubbles are easily gathered.

While the ink jet head of the present invention proves excellent when used with an ink with poor permeability, that is, an ink subject to generation of bubbles, it is naturally also applicable to inks of other kinds. Further, while the present invention is particularly effective for a large ink jet head ejecting a large amount of ink, it is naturally also applicable to a small ink jet head.

As described above, in accordance with the present invention, there is provided in the ink jet head an air duct establishing communication between a region which is substantially free from interference with the ink flow in the ink sump from the ink supply passage to the ink chamber and in which bubbles gather easily and the air region of the ink storage unit, whereby it is possible to reliably prevent the bubbles in the ink from remaining in the ink sump and the head chip, and the bubbles can be removed relatively easily.

What is claimed is:

1. An ink jet head comprising: a plurality of grooves arranged side by side so as to communicate with nozzle openings; an ink chamber for supplying ink to each of the grooves; an ink sump provided so as to communicate with the ink chamber; and ink storage means communicating with the ink sump through ink supply passages, wherein there is provided an air duct establishing communication between a region in the ink sump which is substantially free from interference with an ink flow from the ink supply passages to the ink chamber and in which bubbles easily gather and an air region of the ink storage means.

2. An ink jet head according to claim 1, wherein the ink chamber is provided so as to extend over the direction in which the grooves are arranged side by side, wherein the ink chamber and the ink sump communicate with each other over the direction in which the grooves are arranged side by side, wherein the ink supply passages are provided on both sides of the ink sump with respect to the direction in which the grooves are arranged side by side, and wherein the air duct is provided between the ink supply passages.

3. An ink jet head according to claim 1, wherein the ink sump is equipped with a tapered portion gradually diverging from at least one of the openings of the ink supply passages and the air duct toward the ink chamber.

4. An ink jet head according to claim 1, wherein the ink sump is equipped with a filter situated in the vicinity of the border between the ink sump and the ink chamber.

5. An ink jet head according to claim 4, wherein the air duct communicates with the portion of the ink flow passage which is on the upstream side of the filter of the ink sump.

6. An ink jet recording apparatus equipped with an ink jet head as claimed in claim 1.

* * * * *